US009890012B1

(12) United States Patent
Polen

(10) Patent No.: US 9,890,012 B1
(45) Date of Patent: Feb. 13, 2018

(54) CORD STORAGE AND DEPLOYMENT APPARATUS

(71) Applicant: Michael K. Polen, Tampa, FL (US)

(72) Inventor: Michael K. Polen, Tampa, FL (US)

( * ) Notice: Subject to any disclaimer, the term of this patent is extended or adjusted under 35 U.S.C. 154(b) by 92 days.

(21) Appl. No.: 14/924,649

(22) Filed: Oct. 27, 2015

Related U.S. Application Data

(60) Provisional application No. 62/119,739, filed on Feb. 23, 2015.

(51) Int. Cl.
*B65H 75/48* (2006.01)
*B65H 75/40* (2006.01)

(52) U.S. Cl.
CPC ... *B65H 75/406* (2013.01); *B65H 2701/3919* (2013.01); *B65H 2701/53* (2013.01)

(58) Field of Classification Search
CPC ... B65H 75/406; B65H 75/48; B65H 75/4473
USPC ..... 242/388.1–388.3, 605
See application file for complete search history.

(56) References Cited

U.S. PATENT DOCUMENTS 2,429,675 A 10/1947 Eypper
2,449,464 A 9/1948 Eypper
3,208,121 A * 9/1965 Price ..... H02G 11/02 191/12.2 R
4,150,798 A 4/1979 Aragon
4,726,536 A 2/1988 Lerner
5,915,640 A 6/1999 Wagter
6,065,708 A 5/2000 Matsubara
7,546,969 B2 * 6/2009 Kuramoto ..... B65H 75/406 242/118.2

* cited by examiner

*Primary Examiner* — Sang Kim
(74) *Attorney, Agent, or Firm* — Chad Peterson

(57) ABSTRACT

A cord storage and retrieval apparatus that is operable to be engaged with a midpoint area of undesired slack of a cord so as to wind and store a portion of the cord wherein the ends of the cord remain available or operably coupled to an object. The cord storage and retrieval apparatus includes a lower portion and an upper portion that are rotatably coupled. A channel and sidewall openings are formed within the lower portion so as to facilitate engagement of a cord. A shaft with a slot is operably coupled to the upper portion and extends downward therefrom so as to rotatably engage an aperture formed within the channel. A ceiling structure, couplings, keepers, and connectors are included in some embodiments to facilitate separation movement, rotational resistance control and/or locking functionality. The shaft is further configured to receive a topside locking member from a second unit for stacking purposes.

25 Claims, 5 Drawing Sheets

CORD STORAGE AND DEPLOYMENT APPARATUS

PRIORITY UNDER 35 U.S.C SECTION 119(E) & 37 C.F.R. SECTION 1.78

This nonprovisional application claims priority based upon the following prior United States Provisional Patent Application entitled: Cord Storage and Deployment Apparatus, Application No. 62/119,739 filed Feb. 23, 2015, in the name of Michael K. Polen, which is hereby incorporated by reference for all purposes.

FIELD OF THE INVENTION

The present invention relates generally to organizational devices, more specifically but not by way of limitation, a cord winding apparatus that is operable to receive, store and dispense cord-like objects such as but not limited to electrical cords, rope, window treatment pulls and other similar objects.

BACKGROUND

Cord management has been an issue for many years. There are many types of cords and examples include but are not limited to: electrical cords, computer cables, ropes and strings. Depending upon the application, the management of these objects can prove to be challenging. Many individuals struggle with maintaining ropes and electrical cords tangle free and when needed often struggle to deploy these items in an efficient manner. Storage devices are available for these types of objects to assist in the proper storage thereof so as to maintain in an orderly manner but many of these devices do not provide rapid and efficient loading, unloading, winding, and unwinding capability nor the ability to securely stack, lock, or freely rotate when desired.

Accordingly, there is a need for a cord storage and deployment device that is operable to receive, store and deploy cords, ropes and other similar objects wherein the cord storage and deployment device includes such improved cord management and storage features.

SUMMARY OF THE INVENTION

It is the object of the present invention to provide a cord storage and deployment apparatus that is operable to facilitate the improved storage and deployment of cords and similar objects wherein the cord storage and deployment apparatus includes a first embodiment and a second embodiment.

A further object of the present invention is to provide a cord storage and deployment apparatus operable to improve the storage and deployment of cords and similar objects wherein the said first embodiment and second embodiment includes a lower portion and an upper portion that are rotatably secured and form an interior volume therebetween.

It is the object of the present invention to provide a cord storage and deployment apparatus that is operable to receive, store and deploy cords and similar objects wherein included in the first embodiment and second embodiment thereof the lower portion further comprises a channel that extends across the bottom surface of the lower portion that functions to provide a means to load a cord into the cord storage and deployment apparatus.

Another object of the present invention is to provide a first embodiment and a second embodiment of a cord storage and deployment wherein said channel further includes aligned openings extending up the sides of the lower portion.

An additional object of the present invention is to provide a cord storage and deployment apparatus having a first and second embodiment wherein each is operable to receive, store and deploy cords wherein the lower portion includes a centrally positioned aperture and wherein the aperture of the lower portion is coupled with the channel.

Still a further object of the present invention is to provide a cord storage and deployment apparatus having a first embodiment that is operable to receive, store and deploy cords and similar objects wherein the lower portion includes an upper edge having an outer ridge configured to engage channels formed within the sidewall of the upper portion so as to control the vertical position therebetween.

An alternative object of the present invention is to provide a cord storage and deployment apparatus having a first embodiment that further includes a shaft operable to receive a cord therearound having a first end and a second end with the second end of the shaft being rotatably secured with said centrally positioned aperture of the lower portion.

An additional object of the present invention is to provide a cord storage and deployment apparatus having a first embodiment operable to receive, store and deploy cords wherein the first end of the shaft is operably coupled to a centrally positioned aperture of a plate wherein said plate has a circumferential groove.

Yet another object of the present invention is to provide a cord storage and deployment apparatus wherein the upper edge of the lower portion of the first embodiment further includes an inner portion operable to engage the circumferential groove of the plate.

Still a further object of the present invention is to provide a cord storage and deployment apparatus having a first embodiment wherein the inner portion of the upper edge of the lower portion further includes at least one notch operable to mateably connect with a protrusion on the plate so as to maintain the plate in a fixed position.

Another object of the present invention is to provide a cord storage and deployment apparatus wherein the shaft of the first embodiment includes a slot centrally located operable to receive a portion of a cord therethrough and the slot is formed so as to direct opposing sides of the cord engaged therewith in opposing directions so as to improve the retention and deployment of the cord.

An additional object of the present invention is to provide a cord storage and deployment apparatus having a first embodiment wherein it is contemplated within the scope of the present invention that the shaft thereof includes contoured protrusions secured to opposing sides of the shaft so as to reduce crimping of electrical cords wherein loaded, stored and deployed in the cord storage and deployment apparatus.

Yet a further object of the present invention is to provide a cord storage and deployment apparatus operable to receive, store and deploy cords and the like wherein the first end of the shaft of the first embodiment is operably coupled with a coupling of the upper portion so as to facilitate the rotating of the shaft as the upper portion is rotated and to enable the upper portion to be vertically movable relative to the lower portion.

Still another object of the present invention is to provide a cord storage and deployment apparatus operable to receive, store and deploy cords wherein it is contemplated within the scope of the present invention that the coupling of the upper portion of the first embodiment that is operable to engage the shaft further includes a keeper member that is operable to assist in the vertical positioning of the lower portion and upper portion with respect to each other.

Yet a further object of the present invention is to provide a cord storage and deployment apparatus wherein the plate of the first embodiment has a plurality of depressions formed in the upper surface in an organized pattern wherein the depressions are operable to engage with protrusions extending downward from the lower surface of the upper portion so as to control the rotation intermediate the upper portion and lower portion dependent upon the level of engagement of the depressions and protrusions.

Still another object of the present invention is to provide a cord storage and deployment apparatus operable to receive, store and deploy cords and the like having a second embodiment wherein the second embodiment includes a shaft operable to receive a cord therearound having a first end and a second end with the first end being secured to the lower surface of the upper portion and the second end being rotatable within the centrally positioned aperture of the lower portion.

Another object of the present invention is to provide a cord storage and deployment apparatus having a second embodiment wherein the upper edge of the lower portion includes a plurality of protrusions operable to engage a plurality of depressions located on the lower surface of the upper portion so as to control the rotation resistance between the lower portion and upper portion.

An additional object of the present invention is to provide a cord storage and deployment apparatus having a second embodiment operable to store, receive and deploy cords and the like wherein the upper portion includes a ridge configured to engage a groove of the lower portion so as to rotatably secure the lower portion with the upper portion.

It is a further object of the present invention to provide a cord storage and deployment apparatus operable to receive, store and deploy cords and the like wherein it is contemplated within the scope of the present invention that the shaft of the second embodiment includes contoured protrusions secured to opposing sides of the shaft so as to reduce crimping of electrical cords wherein loaded, stored and deployed in the cord storage and deployment apparatus.

Another object of the present invention is to provide a cord storage and deployment apparatus wherein the shaft of the second embodiment includes a slot centrally located operable to receive a portion of a cord therethrough and the slot is formed so as to direct opposing sides of the cord engaged therewith in opposing directions so as to improve the retention and deployment of the cord.

An alternative object of the present invention is to provide a cord storage and deployment apparatus having a first and second embodiment wherein the second end of the shaft that is operably coupled with the centrally positioned aperture of the lower portion is configured to engage with a locking member on the upper surface of the upper portion so as to facilitate the coupling of an additional cord storage and deployment apparatus.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
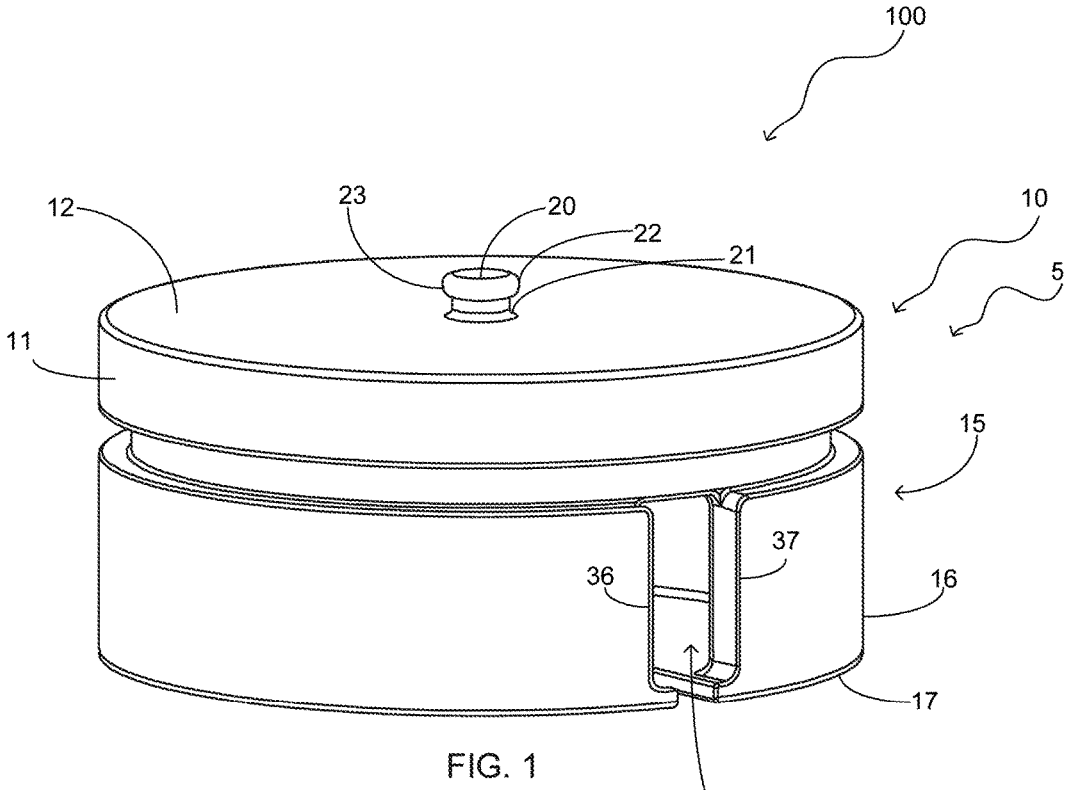
FIG. 1 is a side external view of an embodiment of the present invention.

Referring now to the drawings submitted herewith, wherein various elements depicted therein are not necessarily drawn to scale and wherein through the views and figures like elements are referenced with identical reference numerals, there is illustrated a cord storage and deployment apparatus 100 constructed according to the principles of the present invention.

Figure 2:
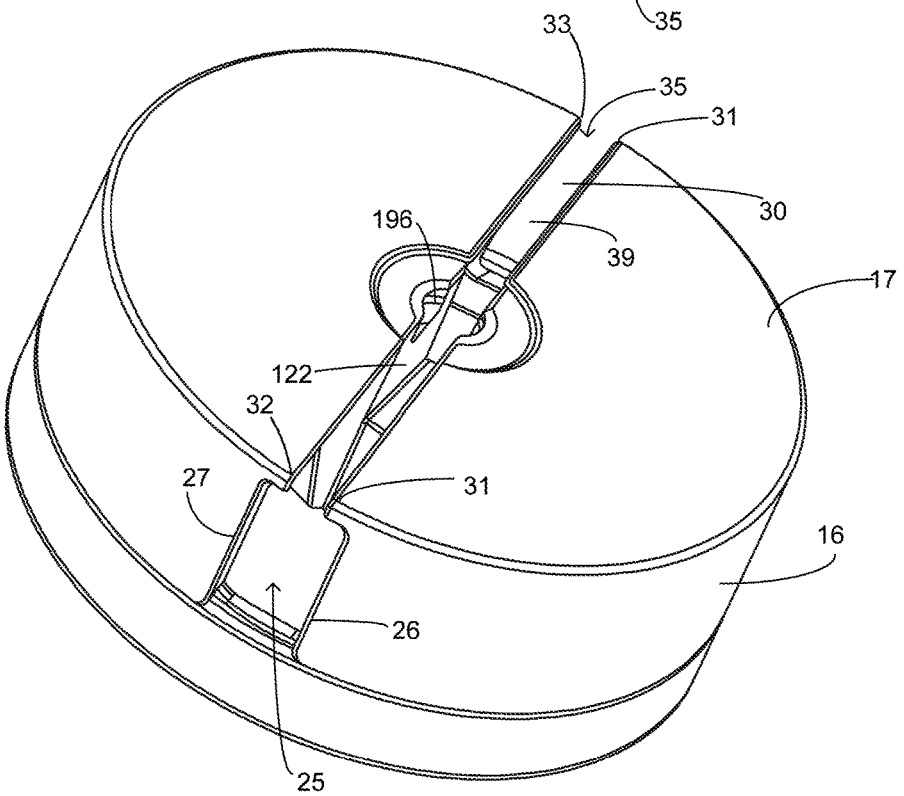
FIG. 2 is a bottom external view of an embodiment of the present invention.
Figure 3:
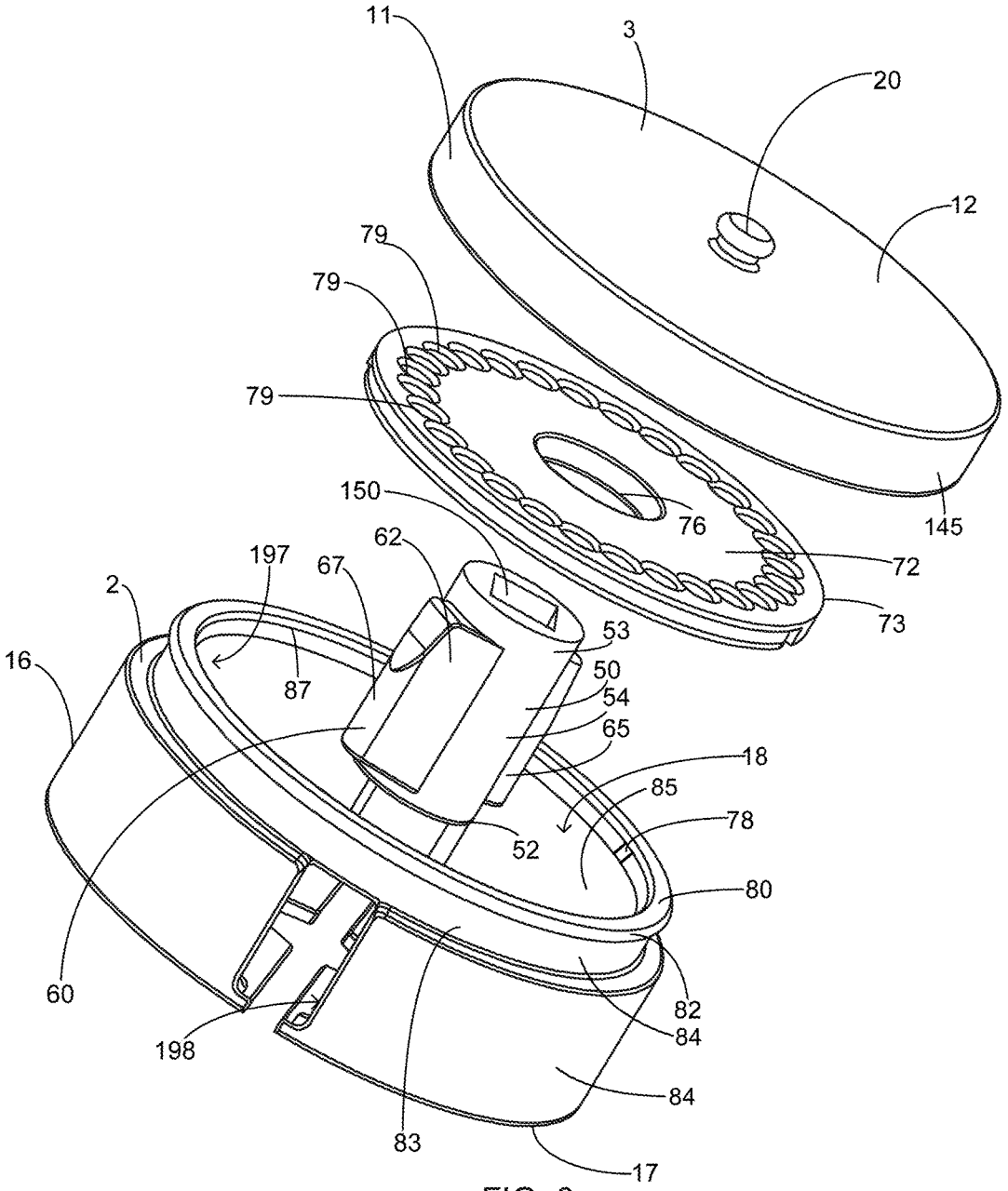
FIG. 3 is side exploded view of an embodiment of the present invention.

Referring in particular to FIGS. 1 and 2 herein the cord storage and deployment apparatus 100 includes body 5 having an upper portion 10 and a lower portion 15 that are rotatably coupled. The body 5 is annular in shape and is manufactured from a suitable durable material such as but not limited to plastic. The upper portion 10 includes sidewall 11 and top 12 being integrally formed. Top 12 includes an upper surface 3 and a lower surface 1. Sidewall 11 includes an interior surface 140 and an exterior surface 145. Integrally formed with top 12 and being generally located in the center thereof is locking member 20. Locking member 20 is perpendicular with top 12 and extends upwards therefrom. Locking member 20 includes lower portion 21 and upper portion 22 wherein the upper portion 22 of locking member 20 is greater in diameter than the lower portion 21 of locking member 20. The upper portion 22 of locking member 20 has an outer surface 23 having a radius, which facilitates the releasable securing into entry portion 51 of recessed portion 119 of shaft 50. The locking member 20 functions to provide a technique allowing a user of the cord storage and deployment apparatus 100 to releasably secure multiple cord storage and deployment apparatus 100 in a vertical stack orientation. While a specific locking member 20 has been illustrated and discussed herein, it is contemplated within the scope of the present invention that multiple cord storage and deployment apparatus 100 could be secured in a vertical stack orientation utilizing various types of fasteners and receivers in order to achieve the desired functionality as described herein.

The lower portion 15 includes sidewall 16 and bottom 17 being integrally formed to create interior volume 18 wherein interior volume 18 is of suitable size to accommodate a cord or similar objected in a rolled configuration. It is contemplated within the scope of the present invention that the cord storage and deployment apparatus 100 could be manufactured in various different sizes so as to accommodate different applications. More specifically but not by way of limitation, the cord storage and deployment apparatus 100 could be sized to accommodate an electrical extension cord or a window blind cord. While an upper portion 10 and lower portion 15 are discussed herein, it should be noted that the terms upper and lower do not reflect any specified orientation and as such the terms upper and lower could be replaced with first and second. The lower portion 15 includes channel 30 formed in the bottom 17 wherein the channel 30 extends across the diameter of the lower portion 15 and includes opening 39 providing access to the interior volume 18. Integrally formed into the sidewall 16 are a first opening 25 and a second opening 35. First opening 25 and second opening 35 are formed in sidewall 16 at opposing ends 31 of the channel 30 wherein channel 30 includes a first end 32 and a second end 33. First opening 25 is defined by opposing lateral perimeter edges 26,27 and is rectangular in shape. Second opening 35 is similarly shaped as first opening 25 and includes opposing lateral perimeter edges 36,37. The channel 30 and its opening 39 are operable to receive a portion of a cord or similar object therein wherein the portion of a cord placed therein is an intermediate portion thereof and not an end portion of a cord. The cord storage and deployment apparatus 100 is operable to retrieve and deploy a cord or similar object wherein the ends of the cord or similar object are either operably coupled to an item or need to remain outside of the cord storage and deployment apparatus 100 in order to facilitate the operable coupling to an item. By way of example but not limitation, a user utilizing the cord storage and deployment apparatus 100 to store a window blind cord would place the body 5 at an approximate midpoint of the exposed window blind cord and insert the window blind cord into the opening 39 of the channel 30 and subsequently rotate the upper portion 10 relative to lower portion 15 as will be further discussed herein. While one channel 30 is discussed and illustrated herein, it is contemplated within the scope of the present invention that the lower portion 15 could have more than one channel 30. More specifically but not by way of limitation, the lower portion 15 could have a second channel formed perpendicular to the channel 30 and include all of the components thereof.

The sidewall 16 of lower portion 15 includes an exterior surface 84, an interior surface 85 and an upper edge 80. The lower portion 15 includes indentation 2 proximate upper edge 80. Indentation 2 extends circumferentially around lower portion 15 and is operable to ensure sidewall 16 and sidewall 11 are aligned once the upper portion 10 and lower portion 15 are operably coupled. Proximate upper edge 80 is outer ridge 82. Outer ridge 82 extends outward from upper sidewall portion 83 and extends circumferentially around the lower portion 15. Outer ridge 82 is operable to engage keepers 180 as further discussed herein in order to facilitate and control the movement of the upper portion 10 intermediate a first position, a second position and a third position. Lower portion 15 further includes an inner ridge 87 proximate upper edge 80 wherein inner ridge 87 extends inward towards the interior volume 18 and is disposed circumferentially around the lower portion 15. Inner ridge 87 is operable to engage groove 95 so as to secure plate member 70 to lower portion 15. While an outer ridge 82 and keepers 180 are illustrated for providing a technique to control vertical movement of the upper portion 10, it is contemplated within the scope of the present invention that alternate elements and configurations could be provided to achieve the desired functionality. Additionally, it is further contemplated within the scope of the present invention that alternatives to the inner ridge 87 could be utilized to provide securing of the plate member 70.

Bottom 17 includes aperture 40 centrally located. Aperture 40 is annular in shape and is operable to receive therein second end 52 of shaft 50. Shaft 50 is rotatable within aperture 40. Shaft 50 is centrally located within body 5 and is rotatably movable in order to receive a cord or similar item therearound. The shaft 50 being manufactured from a suitable rigid material such as but not limited to plastic. Shaft 50 includes second end 52 and first end 53 further having exterior surface 54. Secured to the exterior surface 54 of the shaft 50 are first wing member 60 and second wing member 65. First wing member 60 and second wing member 65 are secured to shaft 50 utilizing suitable durable techniques. First wing member 60 and second wing member 65 are similarly constructed having face 62 that extends outward from exterior surface 54 and further includes rounded edge 67. First wing member 60 and second wing member 65 are diametrically opposed on shaft 50. The shape of the first wing member 60 and second wing member 65 function to provide an increased radius so as to eliminate any potential kinking of a cord during the processing of wrapping around the shaft 50. This is particularly useful for applications wherein a user will utilize the cord storage and deployment apparatus 100 to store electrical cords. While a first wing member 60 and a second wing member 65 have been illustrated and discussed herein, it is contemplated within the scope of the present invention that the shaft 50 could have any number of wing members and further it is contemplated that the shaft 50 could have no wing members formed thereon.

Shaft 50 further includes slot 120. Slot 120 is rectangular in shape having recessed portion 119 and is formed in shaft 50 proximate second end 52. The slot 120 functions to receive and retain a portion of a cord or similar item subsequent the cord being disposed in channel 30 for storage within the cord storage and deployment apparatus 100. The slot 120 further includes a first wall 121 and a second wall 122. While one slot 120 is illustrated and discussed herein, it is contemplated within the scope of the present invention that more than one slot 120 could be present. More specifically but not by way of limitation, a second slot could be formed perpendicularly to slot 120. Slot 120 includes upper surface 199. Upper surface 199 of slot 120 is angular in manner. The angular manner of upper surface 199 of slot 120 is operable to direct a portion of a cord to the bottom area 198 of the lower portion 15 and a portion of a cord to the top area 197 of the lower portion during the winding process so as to promote efficient storage of a cord within the interior volume 18 of the lower portion 15. Second wall 122 further includes concave formation 196. Concave formation 196 is formed within second wall 122 and is operable to releasably secure to the upper portion 22 of the locking member 20. While not particularly illustrated herein, first wall 121 includes an identical concave formation. The locking member 20 engages with concave formation 196 and concave formation in first wall 121 to provide releasable securing of multiple cord storage and deployment apparatus 100.

Rotatably secured to first end 53 of shaft 50 is plate member 70.

Plate member 70 is an annular shaped disc having a lower surface 71 and upper surface 72. Circumferentially disposed around edge 73 of plate member 70 is groove 95. The plate member 70 further includes center aperture 76 that is centrally located and manufactured of suitable diameter to accommodate first end 53 of shaft 50 and shaft 50 is rotatable within center aperture 76. The groove 95 is operable to engage inner ridge 87 subsequent assembly of the cord storage and deployment apparatus 100 and ensuing assembly the plate member 70 remains in a fixed position being secured by the aforementioned elements and technique. Plate member 70 further includes at least one protrusion 77 projecting outward from edge 73 that is operable to engage recess 78. The protrusion 77 is mateably shaped with recess 78 and functions to inhibit any rotational movement of the plate member 70 ensuing the assembly of the cord storage and deployment apparatus 100. It is contemplated within the scope of the present invention that the plate member 70 could have various different quantities of protrusions 77 and recesses 78 in order to achieve the desired functionality as described herein. It is further contemplated within the scope of the present invention that the plate member 70 could be integrally formed with lower portion 15. The upper surface 72 of plate member 70 includes a plurality of depressions 79. The depressions 79 are annular in shape and organized in a ring pattern on the upper surface 72. The depressions 79 are operable to engage fingers 90. Fingers 90 are secured to the lower surface 1 of the top 12 and project downward therefrom. The fingers 90 are rounded in shape and are mateably coupled to the depressions 79 when the upper portion 10 is in its first position and second position as further discussed herein. The fingers 90 function to provide controlled resistance to the rotation of the upper portion 10 relative to the lower portion 15. While a plurality of depressions 79 and fingers 90 have been illustrated herein, it is contemplated within the scope of the present invention that any number of depressions 79 and fingers 90 could be utilized to provide resistance to the rotation of the upper portion 10.

Figure 4:
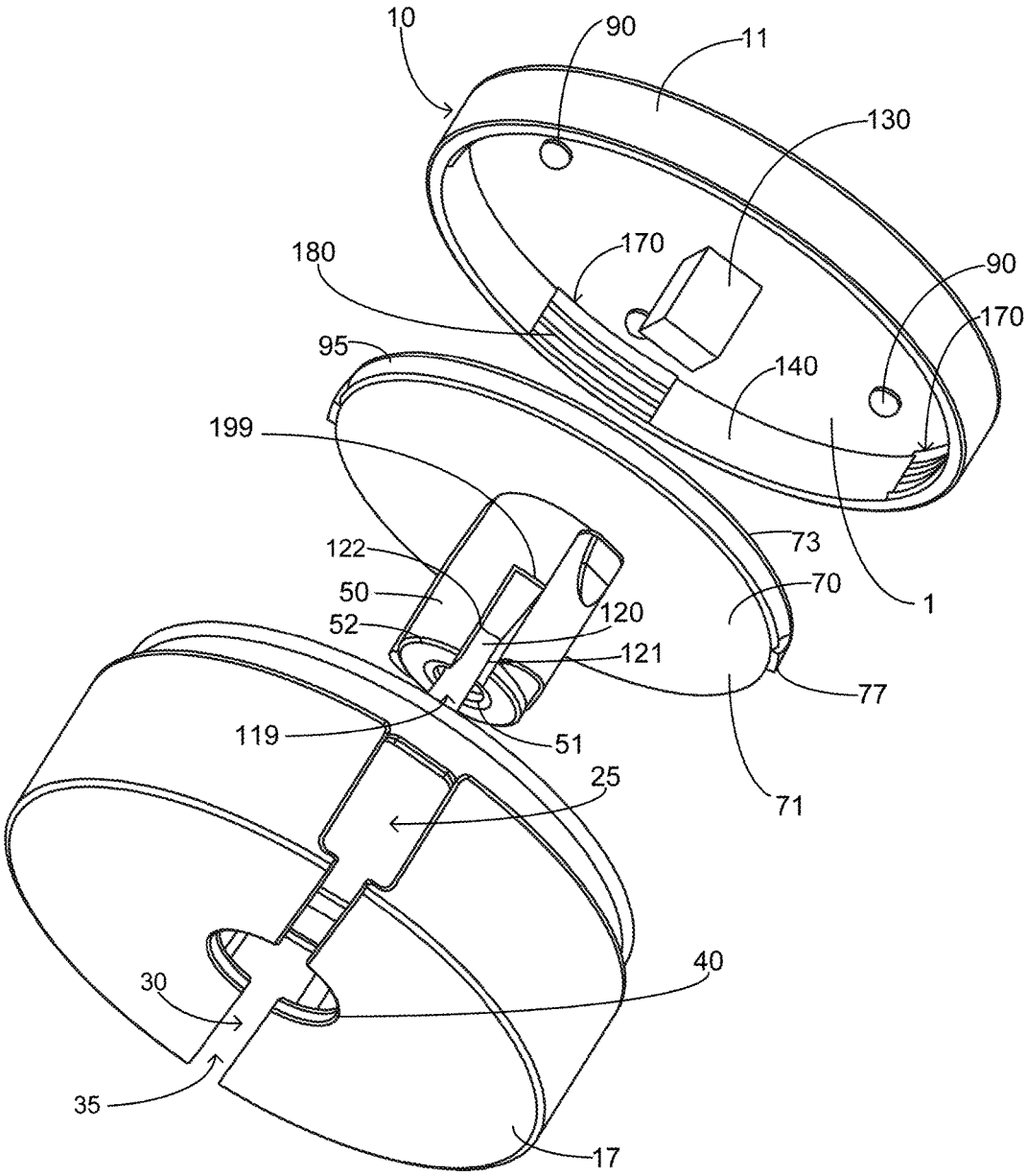
FIG. 4 is a bottom perspective exploded view of an embodiment of the present invention.

Referring in particular to FIG. 4 herein, the upper portion 10 further includes coupling 130. Coupling 130 is centrally located and is formed with the lower surface 1 of top 12 and extends downward therefrom. Coupling 130 is operable to engage with cavity 150 that is present in shaft 50 proximate the first end 53 thereof so as to enable vertical movement of upper portion 10 relative to lower portion 15. The coupling 130 is manufactured so as to be mateably engaged with the cavity 150 and is further manufactured of an appropriate length so as to maintain engagement with the cavity 150 of the shaft 50 when the upper portion 10 is in either of its three positions as discussed herein. Those skilled in the art will recognize that the coupling 130 could be manufactured in numerous different lengths and shapes and be able to achieve the desired functionality as described herein. During use of the cord storage and deployment apparatus 100 as a user grasps and rotates the upper portion 10, the engagement of the coupling 130 and shaft 50 functions to provide the rotational movement of the shaft 50 and as such facilitating a winding of a cord or similar item therearound.

The upper portion 10 further includes a plurality of keepers 180 formed in the interior surface 140 of the sidewall 11. The keepers 180 are formed in a plurality of groups 170 circumferentially around the interior surface 140. Keepers 180 are formed so as to mateably engage outer ridge 82 and provide distinct vertical orientation between the upper portion 10 and lower portion 15. More specifically but not by way of limitation, the keepers 180 engage with the outer ridge 82 to facilitate and control the positioning of the upper portion 10 in a first position, a second position and a third position. While in the illustrations herein the keepers 180 are formed in groups 170, it is contemplated within the scope of the present invention that the keepers 180 could be manufactured so as to be continuously formed around the interior surface 140. It is further contemplated within the scope of the present invention that as few as two groups 170 of keepers 180 could be formed on the interior surface 140.

As previously mentioned herein the upper portion 10 is movable between a first position, a second position and a third position relative to the lower portion 15. The outer ridge 82 is engaged with keepers 180 subsequent the assembly of the cord storage and deployment apparatus 100. In the first position, the upper portion 10 is proximate the lower portion 15 such that the fingers 90 are substantially penetrated into the depressions 79. In this position the upper portion 10 is fixed relative to the lower portion 15 and is not rotatable with respect thereto. In its second position, the upper portion 10 is moved away from said lower portion 15 such that the fingers 90 are only partially engaged with depressions 79. In the second position, the upper portion 10 is rotatable with respect to the lower portion and the rotational movement is stepped or calibrated to rotate with some resistance as provided by the aforementioned position of the fingers 90 being at least partially disposed within the depressions 79 wherein the fingers 90 engaging the depressions 79 provide a stepped rotational movement. In its third position, the upper portion 10 is distal to the lower portion 15 such that the fingers 90 do not engage with the depressions 79 and as such the upper portion 10 is rotatable with respect to the lower portion 15 with no resistance and can freely rotate with respect thereto. While a first position, second position and third position are discussed for controlling the engagement degree of fingers 90 and depressions 79, it is contemplated within the scope of the present invention that any number of engagement positions could be configured. Additionally, it is further contemplated within the scope of the present invention that alternate elements and configurations to control the rotational friction between upper portion 10 and lower portion 15 could be provided.

Figure 5:
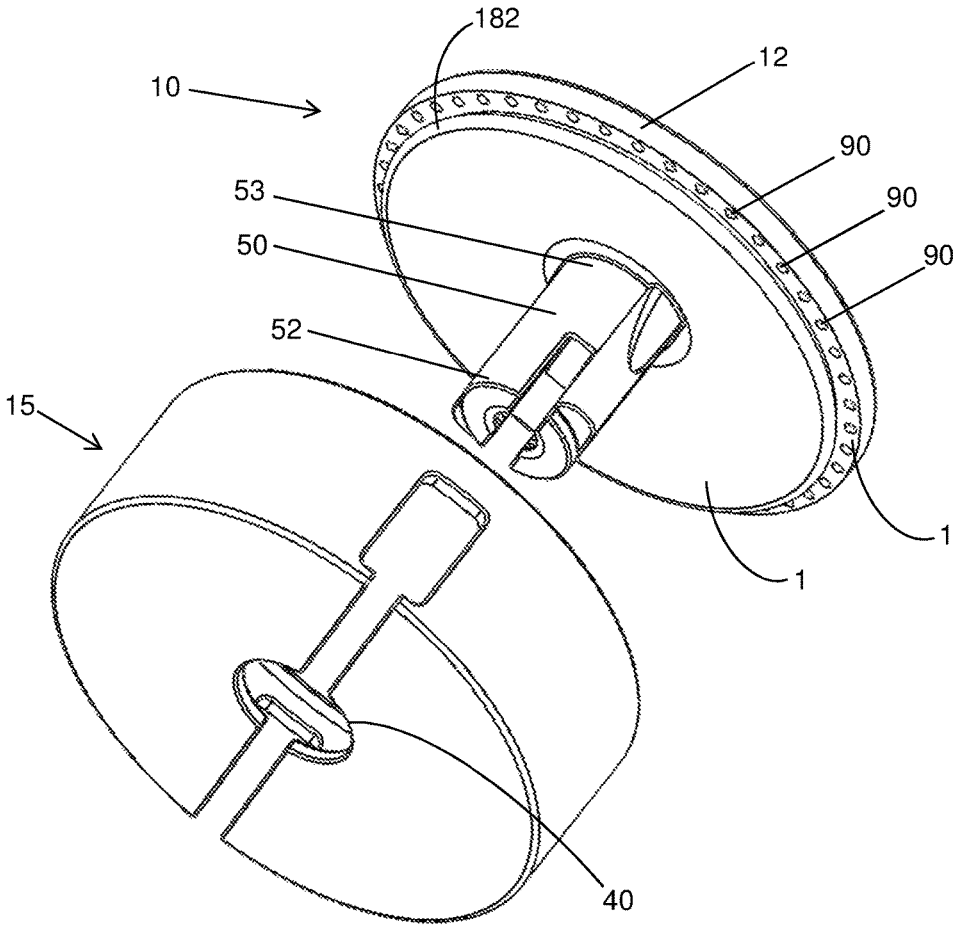
FIG. 5 is a bottom perspective exploded view of an alternative embodiment of the present invention.
Figure 6:
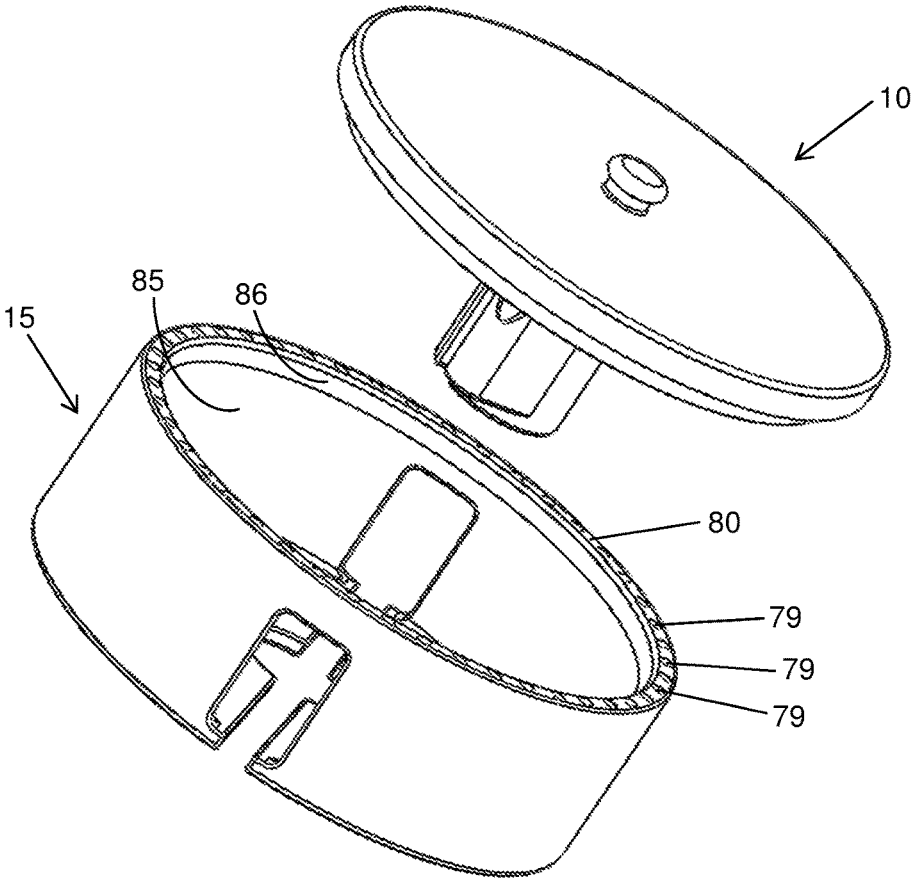
FIG. 6 is a top perspective exploded view of an alternative embodiment of the present invention.

While a plate member 70 has been included and described herein, it is contemplated within the scope of the present invention that an alternative embodiment of the present invention could be constructed without the plate member 70 as illustrated in FIG. 5 and FIG. 6. In this alternative embodiment the first end 53 of shaft 50 is secured to the lower surface 1 of top 12 so as to eliminate the need for coupling 130 and cavity 150. As the upper portion 10 is rotated in this alternative embodiment, the shaft 50 rotates therewith as a result of being secured directly thereto. It is also contemplated within the scope of this alternative embodiment that the depressions 79 could be formed in the upper edge 80 with corresponding fingers 90 formed in the upper portion 10 so as to align and engage therewith to provide stepped rotational movement of upper portion 10 relative to lower portion 15. Those skilled in the art will recognize that the connectors used to create stepped rotational movement of upper portion 10 relative to lower portion 15 are not limited to depressions 79 and fingers 90 and could therefore be a wide variety of shapes and configurations and/or be positioned on aperture 40 and shaft 50 and achieve the same desired functionality as described herein. Additionally, it is contemplated within this alternative embodiment of the scope of the present invention that the upper portion 10 could be configured without keepers 180 and sidewall 11 and only have a first position with respect to the lower portion 15. In this alternative embodiment, the upper portion 10 includes ridge 182 configured to couple with groove 86 formed in the interior surface 85 of the lower portion 15 so as to rotatably secure upper portion 10 with lower portion 15. Those skilled in the art will recognize that the keepers used to rotatably secure the upper portion 10 with the lower portion 15 are not limited to a ridge 182 and a groove 86 and could therefore be a wide variety of shapes and configurations and/or be positioned on aperture 40 and shaft 50 and achieve the same desired functionality as described herein.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

The present invention also offers a variety of new benefits and unexpected results that may not be immediately recognized prior to use:

When utilized on a window blind cord(s), the locking feature enables the user to conveniently operate the window blind cord(s) from below the cord storage and deployment apparatus, which is not possible with conventional winding devices.

The locking feature prevents the cord storage and deployment apparatus from unwinding itself via unraveling or movement forces which is currently a problem and especially prevalent when storing a wound cord that is in a vertical orientation as the weight of the cord applies unwinding forces onto the vertically suspended wound portion.

When the user places the cord storage and deployment apparatus into the freely rotate position, substantial strain is removed from the engaged cord when unwinding the cord as it only takes gentle pulling of each side of the wound cord to unwind.

The implementation of a shaft rotatably mated to a bottom aperture provides an unexpected result of providing the cord storage and deployment apparatus structural integrity wherein the lower portion having a bottom channel and sidewall openings would not have structural integrity without this combination of elements.

The lower portion bottom channel combined with a shaft having a bottom-loading slot enables an unexpected convenience and visual benefit to the user. The user merely needs to place the cord storage and deployment apparatus over a cord to begin the winding and storage process and the unattractive cord engagement elements are hidden by the surface on which it is subsequently placed or resting against.

An alternate embodiment's implementation of a lower portion having a bottom channel and sidewall openings in combination with an upper portion with a formed shaft rotatably mated to a bottom aperture in the lower portion provides a cost advantage by reducing the resulting product to two manufactured components.

The leveraging of the shaft slot to also include a recessed cavity provides the unexpected benefit of enabling a convenient stacking functionality without adding a plurality of visual and unattractive connectors to the lower portion.

Releasably securing and efficient stacking of a plurality of cord storage and deployment apparatuses increases efficient use of highly valued countertop space (for example) tremendously and allow for significant space efficient storage of many spare cords wound and stored in a multitude of cord storage and deployment apparatuses.

What is claimed is:

1. A cord winding and storage apparatus comprising:

a body, said body including an upper portion and a lower portion, said upper portion and said lower portion being rotatably coupled, said upper portion being superposed said lower portion, said lower portion including a bottom and a sidewall defining an interior volume, said bottom of said lower portion including an aperture;

a shaft, said shaft having a first end and a second end, said shaft being operably coupled with or secured to said upper portion and extending downward into said interior volume, said shaft being rotatable with said upper portion relative to said lower portion; and a recessed portion, said recessed portion being formed in said second end of said shaft, said recessed portion comprising an entry portion, said recessed portion of said shaft being accessible through said aperture;

wherein said entry portion is operable to facilitate the releasable securement of another object thereto.

2. The cord winding and storage apparatus as recited in claim 1, wherein said upper portion includes a locking member, said locking member extending upward from said upper portion, said locking member being operable to releasably couple with said entry portion of said second cord winding and storage apparatus so as to facilitate releasably secured stacking of a plurality of cord winding and storage apparatuses.

3. The cord winding and storage apparatus as recited in claim 2, wherein said locking member includes an upper portion and a lower portion, said upper portion of said locking member being greater in one of a width or a diameter than said lower portion of said locking member, said entry portion being configured to releasably secure said upper portion of said locking member of a second cord winding and storage apparatus.

4. The cord winding and storage apparatus as recited in claim 1, wherein said lower portion of said body includes a channel extending across said bottom so as to provide loading access to said interior volume from beneath said lower portion of said body, said aperture being formed with said channel, said second end of said shaft includes a slot, said slot being operable to align with said channel during rotation of said upper portion of said body relative to said lower portion of said body so as to load a portion of a cord therein, said entry portion being formed with said slot of said shaft.

5. A cord winding and storage apparatus comprising:

a body, said body including an upper portion and a lower portion, said upper portion and said lower portion being rotatably coupled, said upper portion being superposed said lower portion, said lower portion including a bottom and a sidewall defining an interior volume;

a shaft, said shaft having a first end and a second end, said shaft being operably coupled to said upper portion and extending downward into said interior volume, said shaft being rotatable with said upper portion relative to said lower portion;

a first coupling, said first coupling being secured to or formed with said upper portion; and a second coupling, said second coupling being secured to or formed with said shaft proximate said first end of said shaft, said first coupling being operable to movably couple with said second coupling;

wherein said first coupling and said second coupling facilitating rotational movement of said shaft correspondent with rotational movement of said upper portion relative to said lower portion, said first coupling and said second coupling further facilitating movement capability of said upper portion toward or away from said lower portion.

6. The cord winding and storage apparatus as recited in claim 5, wherein either said first coupling or said second coupling is a cavity or aperture.

7. The cord winding and storage apparatus as recited in claim 5, wherein said sidewall of said lower portion includes an upper edge, said cord winding and storage apparatus includes a ceiling structure proximate said upper edge, said ceiling structure including a center aperture, said shaft being rotatably coupled with said center aperture of said ceiling structure so as to facilitate rotational movement and positioning of said shaft.

8. The cord winding and storage apparatus as recited in claim 7, wherein said upper portion includes at least one first connector, said ceiling structure includes at least one second connector, said at least one second connector being operable to engage said at least one first connector so as to facilitate control of the rotational resistance on and locking capability of said upper portion as said upper portion is moved toward or away from said lower portion.

9. The cord winding and storage apparatus as recited in claim 5, wherein said lower portion includes a channel extending across said bottom so as to provide loading access to said interior volume from beneath said lower portion of said body, said second end of said shaft includes a slot, said slot being operable to align with said channel during rotation of said upper portion relative to said lower portion so as to load a portion of a cord therein.

10. The cord winding and storage apparatus as recited in claim 9, wherein said channel of said lower portion includes an aperture, said shaft being rotatably coupled with said aperture so as to facilitate rotational control of said shaft.

11. A cord winding and storage apparatus comprising:

a body, said body including an upper portion and a lower portion, said upper portion and said lower portion being rotatably coupled, said upper portion being superposed said lower portion, said lower portion including a bottom and a sidewall defining an interior volume;

a shaft, said shaft having a first end and a second end, said shaft being operably coupled to said upper portion and extending downward into said interior volume, said shaft being rotatable with said upper portion relative to said lower portion; and at least one first keeper, said at least one first keeper being secured to said upper portion so as to facilitate controlled user movement of said upper portion toward or away from said lower portion into a plurality of positions.

12. The cord winding and storage apparatus as recited in claim 11, wherein said lower portion includes at least one second keeper, said at least one second keeper being operable to engage said at least one first keeper so as to facilitate additional control of the user movement of said upper portion toward or away from said lower portion.

13. The cord winding and storage apparatus as recited in claim 11, wherein said upper portion includes a sidewall, said at least one first keeper is secured to said sidewall of said upper portion.

14. The cord winding and storage apparatus as recited in claim 11, wherein said sidewall of said lower portion includes an upper edge, said cord winding and storage apparatus includes a ceiling structure proximate said upper edge, said ceiling structure including a center aperture, said shaft being rotatably coupled with said center aperture of said ceiling structure so as to facilitate rotational movement and positioning of said shaft.

15. The cord winding and storage apparatus as recited in claim 14, wherein said upper portion includes at least one first connector, said ceiling structure includes at least one second connector, said at least one second connector being operable to engage said at least one first connector so as to facilitate control of the rotational resistance on and locking capability of said upper portion as said upper portion is moved toward or away from said lower portion.

16. The cord winding and storage apparatus as recited in claim 11, wherein said lower portion includes a channel extending across said bottom so as to provide loading access to said interior volume from beneath said lower portion of said body, said second end of said shaft includes a slot, said slot being operable to align with said channel during rotation of said upper portion relative to said lower portion so as to load a portion of a cord therein.

17. The cord winding and storage apparatus as recited in claim 16, wherein said channel of said lower portion includes an aperture, said shaft being rotatably coupled with said aperture so as to facilitate rotational control of said shaft.

18. The cord winding and storage apparatus as recited in claim 11, wherein a first coupling is secured to or formed with said upper portion, a second coupling is secured to or formed with said shaft proximate said first end of said shaft, said first coupling being operable to movably couple with said second coupling, said first coupling and said second coupling facilitating rotational movement of said shaft correspondent with rotational movement of said upper portion relative to said lower portion, said first coupling and said second coupling further facilitating movement capability of said upper portion toward or away from said lower portion.

19. A cord winding and storage apparatus comprising:

a body, said body including an upper portion and a lower portion, said upper portion and said lower portion being rotatably coupled, said upper portion being superposed said lower portion, said lower portion including a bottom and a sidewall defining an interior volume, said lower portion including a channel extending across said bottom so as to provide loading access to said interior volume from beneath said lower portion of said body, said channel including an aperture, said channel having a first end and a second end, said channel including a first opening proximate said first end of said channel, said channel including a second opening proximate said second end of said channel, said first opening and said second opening being formed in said sidewall of said lower portion, said upper portion including at least one first keeper, said lower portion including at least one second keeper, said at least one first keeper being operable to mateably engage said at least one second keeper so as to rotatably secure said upper portion to said lower portion; and a shaft, said upper portion including said shaft, said shaft being secured to said upper portion and extending downward into said interior volume, said shaft having a first end and a second end, said shaft being rotatable with said upper portion relative to said lower portion, said second end of said shaft including a slot, said slot is operable to align with said channel during rotation of said upper portion relative to said lower portion so as to load a portion of a cord therein.

20. The cord winding and storage apparatus as recited in claim 19, wherein said at least one second keeper is secured to or formed with one or more of said sidewall of said lower portion and said aperture of said lower portion.

21. The cord winding and storage apparatus as recited in claim 19, wherein said upper portion includes at least one first connector, said lower portion includes at least one second connector, said at least one second connector being secured to or formed with one or more of said sidewall of said lower portion and said aperture of said lower portion, or in proximity to said aperture, said at least one first connector being operable to engage said at least one second connector so as to facilitate step rotation movement when said upper portion is rotated relative to said lower portion.

22. The cord winding and storage apparatus as recited in claim 19, wherein said slot includes a first wall and a second wall having a distance therebetween, and said first opening and said second opening are at least 75% greater in width than the distance between said first wall and said second wall of said slot so as to inhibit binding and increase storage capacity.

23. The cord winding and storage apparatus as recited in claim 19, wherein said shaft is rotatably coupled with said aperture of said channel.

24. The cord winding and storage apparatus as recited in claim 19, wherein said slot includes an upper surface, said upper surface of said slot being angular in manner so as to direct a portion of a cord to a bottom area of said lower portion and a portion of a cord to a top area of said lower portion during winding of a cord into the cording winding and storage apparatus so as to improve storage efficiency and inhibit binding.

25. The cord winding and storage apparatus as recited in claim 19, wherein said shaft includes at least one wing member, said at least one wing member extending outward from said shaft, said at least one wing member being configured to inhibit kinking of a cord wrapped therearound.

* * * * *